US012325058B2

(12) United States Patent
Tong et al.

(10) Patent No.: US 12,325,058 B2
(45) Date of Patent: Jun. 10, 2025

(54) APPARATUS AND METHOD FOR BENDING HEAT EXCHANGER

(71) Applicant: SANHUA (HANGZHOU) MICRO CHANNEL HEAT EXCHANGER CO., LTD., Zhejiang (CN)

(72) Inventors: Zhongyao Tong, Zhejiang (CN); Yonglong Yang, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 728 days.

(21) Appl. No.: 17/614,888

(22) PCT Filed: Jun. 1, 2020

(86) PCT No.: PCT/CN2020/093678
§ 371 (c)(1),
(2) Date: Nov. 29, 2021

(87) PCT Pub. No.: WO2020/239121
PCT Pub. Date: Dec. 3, 2020

(65) Prior Publication Data

US 2022/0234092 A1 Jul. 28, 2022

(30) Foreign Application Priority Data

May 31, 2019 (CN) ..... 201910470365.3

(51) Int. Cl.
*B21D 53/06* (2006.01)

(52) U.S. Cl.
CPC ..... *B21D 53/06* (2013.01)

(58) Field of Classification Search
CPC ..... B21D 53/06; B21D 7/022; B21D 9/01
See application file for complete search history.

(56) References Cited

U.S. PATENT DOCUMENTS 3,283,402 A 11/1966 Larson
2016/0175999 A1* 6/2016 Heo ..... B23P 15/26 72/115

FOREIGN PATENT DOCUMENTS

CN 108555086 A 9/2018
JP S52146759 A 12/1977
(Continued)

OTHER PUBLICATIONS

Extended European Search Report dated May 12, 2023, for corresponding European Application No. 20815482.3.
(Continued)

*Primary Examiner* — Rick K Chang
(74) *Attorney, Agent, or Firm* — David D. Brush; Westman, Champlin & Koehler, P.A.

(57) ABSTRACT

An apparatus and a method for bending a heat exchanger. The apparatus includes: a plurality of support members, each of which includes a first support plate having a first support surface, a second support plate having a second support surface, and a connecting plate. The first support plate and the second support plate are spaced apart in a transverse direction. A distance between the first support surface and the second support surface keeps unchanged during bending a heat exchanger. A distance between a first support surface and a second support surface of one support member of any two support members is equal to a distance between a first support surface and a second support surface of the other support member. A connecting component connects the plurality of support members in a longitudinal direction.

5 Claims, 12 Drawing Sheets

(56) References Cited

FOREIGN PATENT DOCUMENTS

| | | | |
|---|---|---|---|
| JP | S58151922 | A | 9/1983 |
| JP | H08174082 | A | 7/1996 |
| JP | 2000117334 | A | 4/2000 |
| JP | 2007203366 | A | 8/2007 |

OTHER PUBLICATIONS

International Search Report dated Aug. 11, 2020 for corresponding International Application No. PCT/CN2020/093678, Jun. 1, 2020.
Written Opinion of the International Searching Authority dated Aug. 11, 2020 for corresponding International Application No. PCT/CN2020/093678, filed Jun. 1, 2020.
English translation of Chinese Office Action dated Jun. 4, 2021 for corresponding Chinese Application No. 201910470365.3.
English translation of Japanese Notice of Reasons for Refusal dated Aug. 30, 2022 for corresponding Japanese Application No. 2021-571016.
English translation of the Written Opinion of the International Searching Authority dated Sep. 4, 2020 for corresponding International Application No. PCT/CN2020/093678, filed Jun. 1, 2020.

* cited by examiner

APPARATUS AND METHOD FOR BENDING HEAT EXCHANGER

CROSS-REFERENCE TO RELATED APPLICATIONS

This application is a Section 371 National Stage Application of International Application No. PCT/CN2020/093678, filed Jun. 1, 2020 and published as WO 2020/239121 on Dec. 3, 2020, not in English, which claims priority and rights to Chinese Patent Application No. 201910470365.3, filed on May 31, 2019, which are incorporated herein by reference in their entireties.

FIELD

This application belongs to the field of heat exchange device technologies, and specifically, relates to an apparatus for bending a heat exchanger and a method for bending a heat exchanger.

BACKGROUND

Heat exchangers are widely applied to heat exchange systems such as heat pumps and air conditioners. To increase a heat exchange area, a heat exchanger usually uses two or more rows in series and the heat exchanger is bent. In the related art, when a heat exchange tube is bent, a bend radius of an inner row of heat exchange tube section close to a center of curvature is different from that of an outer row of heat exchange tube segment away from the center of curvature. Therefore, compared to a flat state, heat exchange tube segments of different rows have relative motion during a bending process, making it difficult to maintain a consistent distance between different areas of two adjacent heat exchange tube sections. This affects a shape and a heat exchange effect of an entire heat exchanger after the forming, and improvements need to be made.

SUMMARY

An embodiment of this application proposes an apparatus for bending a heat exchanger. The apparatus includes: a plurality of support members, where the plurality of support members are arranged to be spaced apart in a longitudinal direction, each of the support members includes a first support plate, a second support plate, and a connecting plate connected between the first support plate and the second support plate, the first support plate and the second support plate are spaced apart in a transverse direction, the first support plate has a first support surface that faces away from the second support plate in the transverse direction and that is configured to abut against a heat exchanger, the second support plate has a second support surface that faces away from the first support plate in the transverse direction and that is configured to abut against the heat exchanger, a distance between the first support surface and the second support surface keeps unchanged during a heat exchanger bending process, and a distance between a first support surface and a second support surface of one support member of any two support members is equal to a distance between a first support surface and a second support surface of the other support member; and a connecting component, where the connecting component connects the plurality of support members in the longitudinal direction.

An embodiment of this application proposes an apparatus for bending a heat exchanger. The apparatus includes: a plurality of support rollers, where the plurality of support rollers are arranged to be spaced apart in a longitudinal direction, each of the support rollers includes a first support surface and a second support surface that are spaced apart in a transverse direction and that are configured to abut against a heat exchanger, a distance between the first support surface and the second support surface keeps unchanged during a heat exchanger bending process, and a distance between a first support surface and a second support surface of one support roller of any two support rollers is equal to a distance between a first support surface and a second support surface of the other support roller; and a connecting component, where the connecting component connects the plurality of support rollers in the longitudinal direction.

This application further discloses a method for bending a heat exchanger, where the heat exchanger includes a first header, a second header, and a plurality of heat exchange tubes; the first header and the second header are arranged in parallel and adjacent to each other, and the heat exchange tube is a flat tube; a first end of the heat exchange tube is connected to the first header, and a second end of the heat exchange tube is connected to the second header, so as to connect the first header and the second header; the plurality of the heat exchange tubes are distributed in a length direction of the first header or the second header; the heat exchange tubes are arranged parallel to each other in the length direction of the first header or the second header; fins are arranged between adjacent flat tubes, and the heat exchange tube includes a bent section and at least two rows of substantially parallel heat exchange tube sections in a width direction of the heat exchange tube; and the bending method includes: placing the apparatus for bending a heat exchanger according to any one of the foregoing embodiments between the at least two rows of substantially parallel heat exchange tube sections, where the first support surface and the second support surface each abut against the heat exchange tube section and/or the fin; and a transverse direction of the support member is substantially parallel to the width direction of the heat exchange tube section, and a longitudinal direction of the support member is substantially parallel to a length direction of the heat exchange tube section; and simultaneously bending the at least two rows of heat exchange tube sections around a direction parallel to an axial direction of the first header and an axial direction of the second header.

The additional aspects and advantages of this application are partially given in the following description, and some of them become obvious from the following description, or are understood through practice of this application.

BRIEF DESCRIPTION OF THE DRAWINGS

The foregoing and/or additional aspects and advantages of this application become obvious and easy to understand from the description of the embodiments with reference to the accompanying drawings, in which.

DETAILED DESCRIPTION

Figure 1:
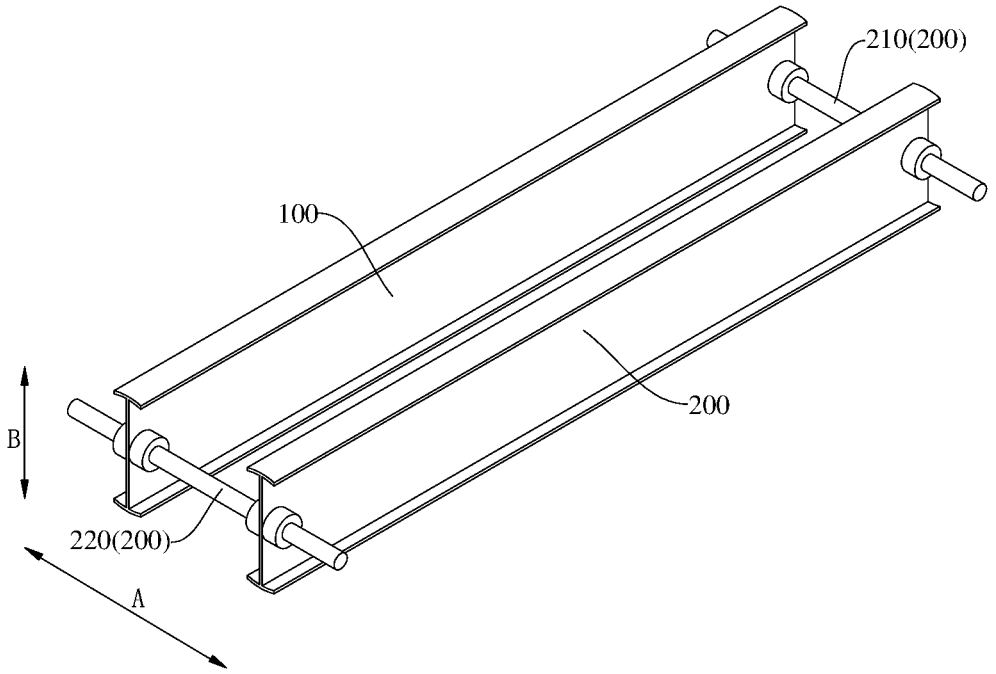
FIG. 1 is a schematic structural diagram of an apparatus according to a first embodiment of this application.

Embodiments of this application are described in detail below, and examples of the embodiments are shown in the accompanying drawings. Throughout the accompanying drawings, a same or similar number denotes a same or similar component or a component with a same or similar function. The embodiments described below with reference to the accompanying drawings are examples, and are merely intended to explain this application, but shall not be understood as a limitation on this application.

As shown in FIG. 8 to FIG. 12 and FIG. 14 to FIG. 20, a heat exchanger includes a first header 610, a second header 620, and a plurality of heat exchange tubes 630.

An axial direction of the first header 610 is parallel to an axial direction of the second header 620, and the first header 610 and the second header 620 may be arranged in parallel and spaced apart from each other. The first header 610 may be used as an inlet header, the second header 620 may be used as an outlet header, or the first header 610 may be used as an outlet header, and the second header 620 can be used as an inlet header.

The plurality of heat exchange tubes 630 may be arranged to be spaced apart in the axial direction of the first header 610 and a length direction of the second header 620, and the plurality of heat exchange tubes 630 are arranged in parallel in a length direction of the first header 610 or the length direction the second header 620. A first end of each heat exchange tube 630 is connected to the first header 610, and a second end of each heat exchange tube 630 is connected to the second header 620, so as to connect the first header 610 and the second header 620. In this way, a heat exchange medium can flow along a the first header 610—the heat exchange tube 630—second header 620 or along a path: the second header 620—the heat exchange tube 630—the first header 610. The first header 610 may be provided with a first interface, and the second header 620 may be provided with a second interface. The first interface and the second interface are configured to connect to an external pipeline, so as to connect the heat exchanger to an entire air conditioning system or another heat exchange system.

The heat exchange tube 630 is a flat tube, and fins are arranged between adjacent flat tubes. The heat exchange tube 630 includes a bent section 631 and at least two rows of heat exchange tube sections 632 that are substantially parallel in a width direction of the heat exchange tube 630. The bent section 631 is formed by bending the heat exchange tube 630 around parallel to the length direction parallel of the first header 610, and a first heat exchange tube section 632 and a second heat exchange tube section 632 are parallel to each other.

The following describes an apparatus for bending a heat exchanger according to an embodiment of this application with reference to FIG. 1 to FIG. 12.

As shown in FIG. 1 to FIG. 12, an apparatus for bending a heat exchanger according to an embodiment of this application includes a plurality of support members 100 and a connecting component 200.

The plurality of support members 100 are arranged to be spaced apart in a longitudinal direction A, and each of the support members 100 includes a first support plate 110, a second support plate 120, and a connecting plate 130 connected between the first support plate 110 and the second support plate 120. The first support plate 110 and the second support plate 120 are spaced apart in a transverse direction B. The first support plate 110 has a first support surface 111 that faces away from the second support plate 120 in the transverse direction B and that is configured to abut against a heat exchanger, and the second support plate 120 has a second support surface 121 that faces away from the first support plate 110 in the transverse direction B and that is configured to abut against the heat exchanger. A distance between the first support surface 111 and the second support surface 121 keeps unchanged during a heat exchanger bending process. A distance between a first support surface 111 and a second support surface 121 of one support member 100 of any two support members 100 is equal to a distance between a first support surface 111 and a second support surface 121 of the other support member 100. The connecting component 200 connects the plurality of support members 100 in the longitudinal direction A.

In an actual use process of the apparatus, the longitudinal direction A is a length direction of a heat exchange tube 630, and the transverse direction B is a distribution direction of at least two rows of heat exchange tube sections 632 of each heat exchange tube 630.

It should be noted that during a bending process, bending radii of an outer heat exchange tube section 632 and an inner heat exchange tube section 632 are different. Therefore, compared with a flat state, the heat exchange tube sections 632 have relative motion during the bending process. According to the apparatus for bending a heat exchanger in this application, the plurality of support members 100 are disposed to provide support between two rows of heat exchange tube sections 632, and a distance between the first support surface 111 and the second support surface 121 of each support member 100 is equal. In this way, fixed support is formed between the two rows of heat exchange tube sections 632 to ensure that a distance between the two rows of heat exchange tube sections 632 meets design requirements and does not change significantly during the bending process.

As shown in FIG. 8 to FIG. 11, for a plurality of rows of misaligned heat exchange tube sections 632, using the apparatus for bending a heat exchanger in this application can accurately ensure a length difference between two rows of heat exchange tube sections 632 and ensure that a processed product meets design requirements.

Certainly, the apparatus in this embodiment of this application may also be applied to aligned heat exchange tube sections 632.

Figure 8:
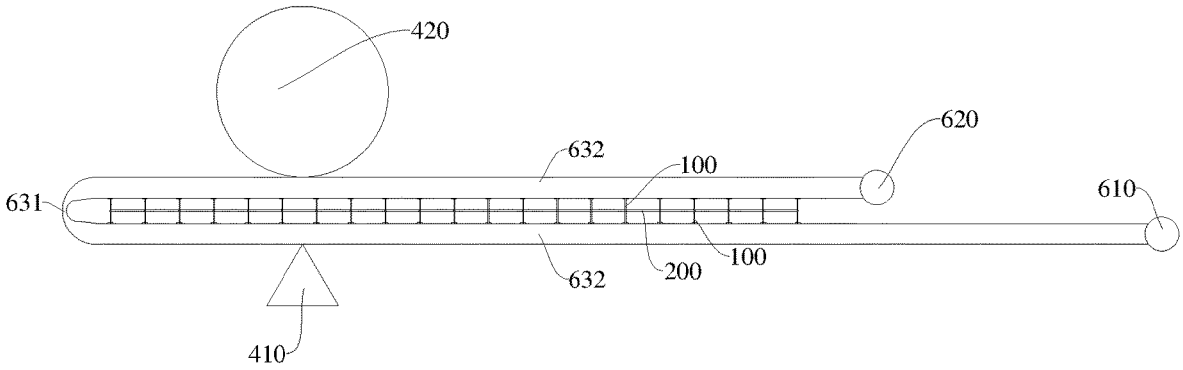
FIG. 8 is a schematic diagram of an apparatus at an initial stage of bending according to a first, second, or third embodiment of this application.
Figure 9:
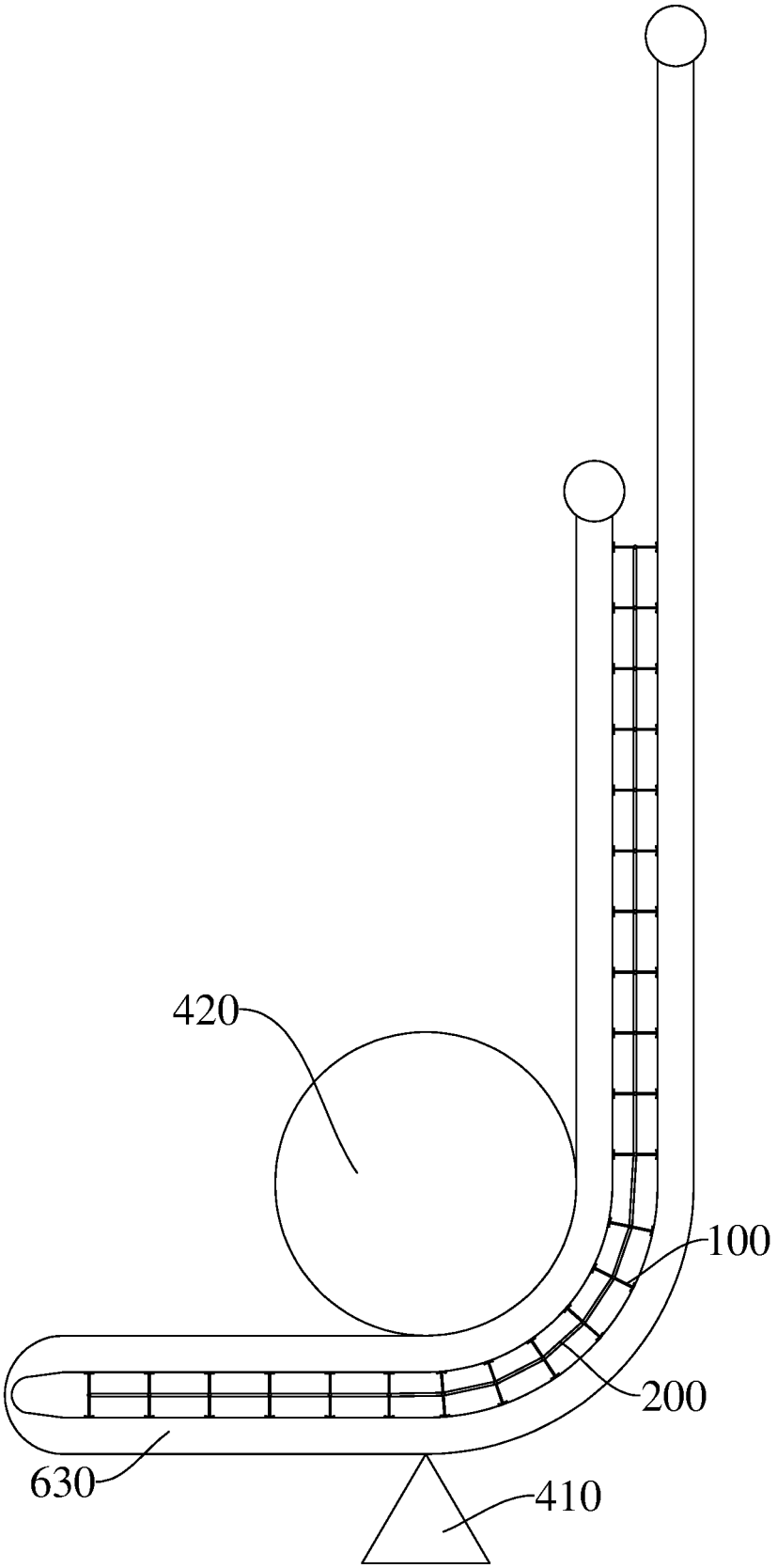
FIG. 9 is a schematic diagram of an apparatus at a completed stage of bending according to a first, second, or third embodiment of this application.
Figure 10:
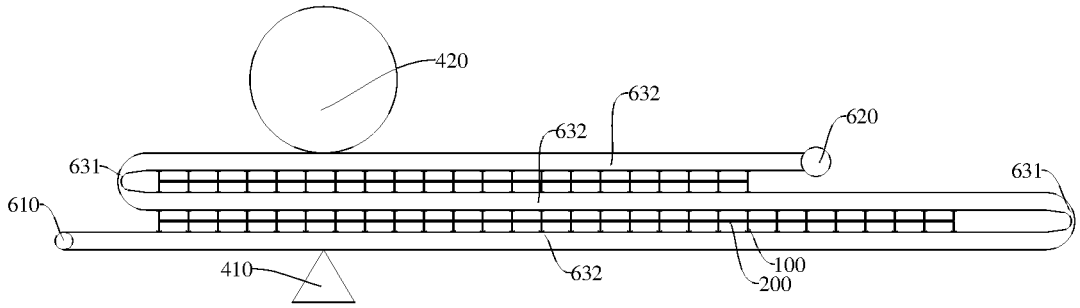
FIG. 10 is a schematic diagram of an apparatus at an initial stage of bending according to a first, second, or third embodiment of this application.
Figure 11:
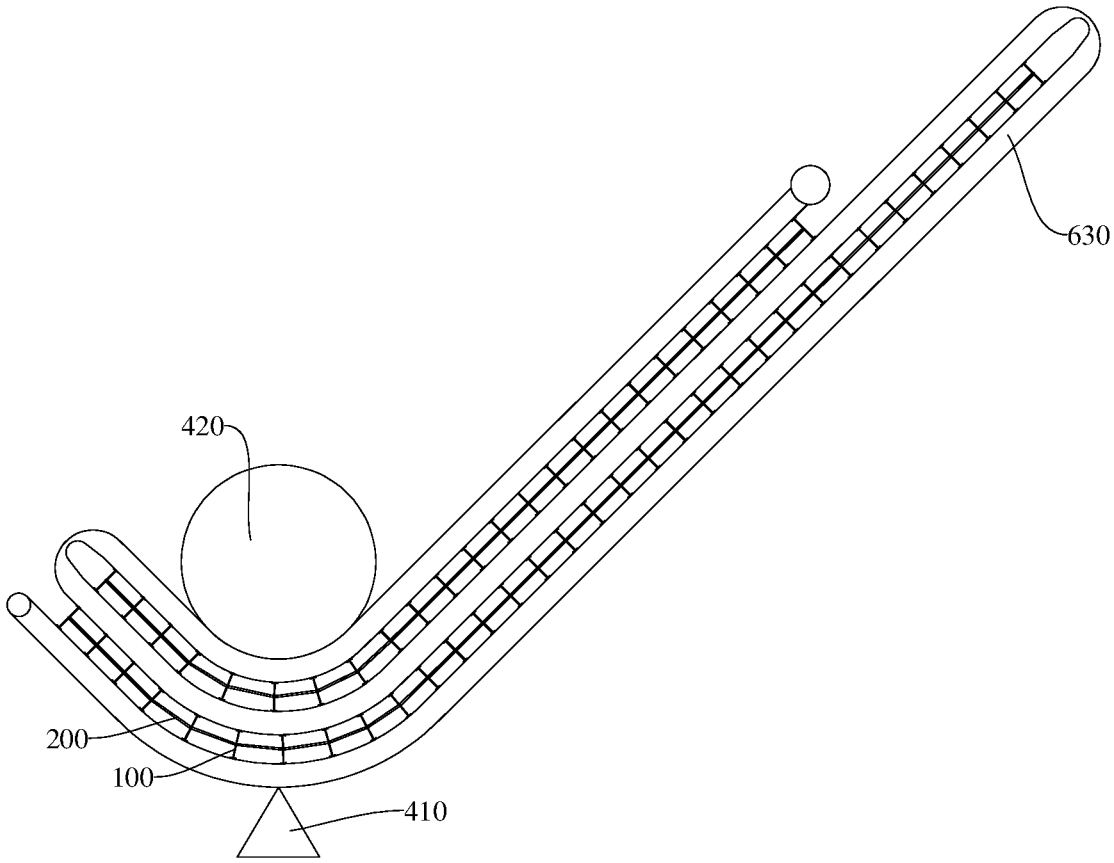
FIG. 11 is a schematic diagram of an apparatus at a completed stage of bending according to a first, second, or third embodiment of this application.

As shown in FIG. 8 and FIG. 9, the apparatus in this embodiment of this application can be used in a heat exchanger with two rows of heat exchange tube sections 632. As shown in FIG. 10 and FIG. 11, the apparatus in this embodiment of this application may be in a heat exchanger with more than two rows of heat exchange tube sections 632.

The apparatus for bending a heat exchanger in this application can provide fixing support for a plurality of rows of heat exchange tube sections 632 during a bending process, to ensure an overall size of a bent heat exchanger, and help improve efficiency and quality of a bending process.

In some embodiments, as shown in FIG. 2, FIG. 4, FIG. 5, and FIG. 12, the first support surface 111 and the second support surface 121 are arc-shaped, and a first support surface 111 and a second support surface 121 of a same support member 100 protrude toward a direction away from each other. The convex first support surface 111 and the second support surface 121 can ensure that during the bending process, at least a part of the first support surface 111 and the second support surface 121 can always implement effective support, that is, always keep in contact with the heat exchange tube section 632.

Figure 2:
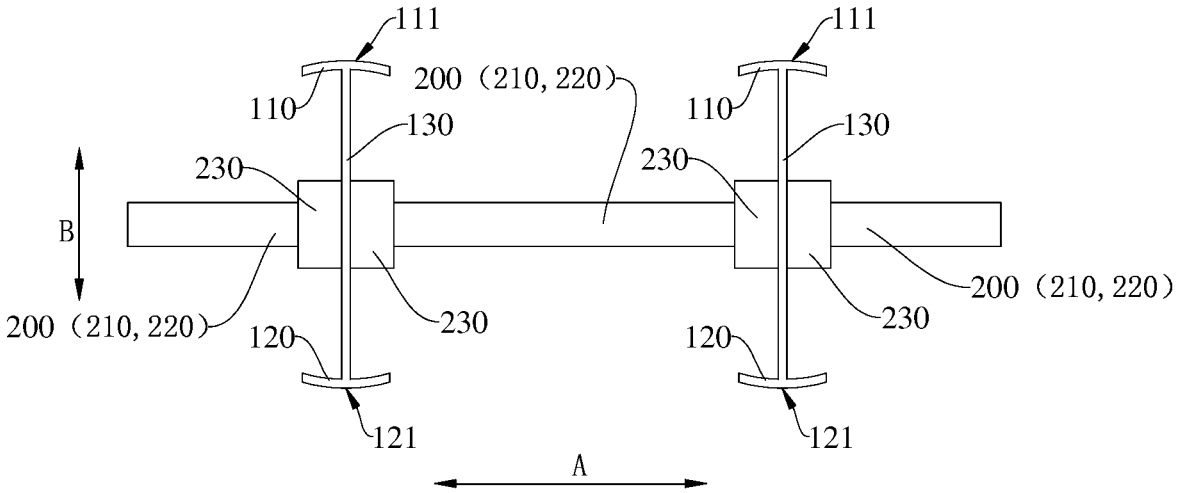
FIG. 2 is a schematic diagram of an apparatus viewed from an end face according to a first embodiment of this application.

In the embodiment shown in FIG. 1 and FIG. 2, a distance between a first support plate 110 and a second support plate 120 of a same support member 100 is fixed, the apparatus may be used to process heat exchangers of a fixed size, and the apparatus has a simple structure and a low cost.

Figure 3:
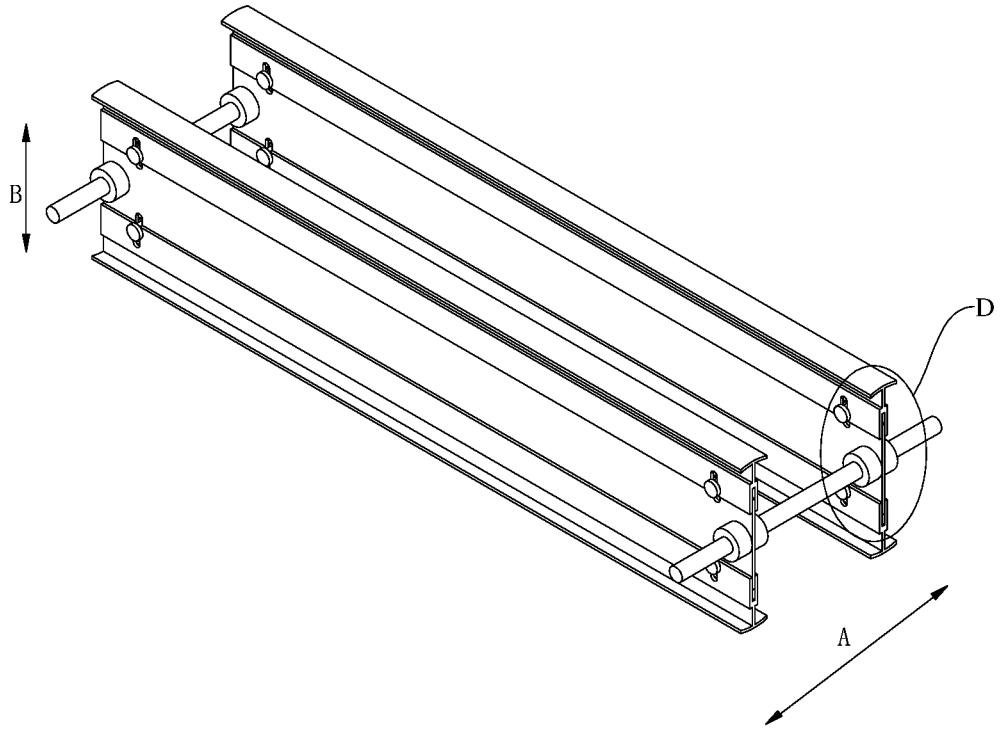
FIG. 3 is a schematic structural diagram of an apparatus according to a second embodiment of this application.
Figure 4:
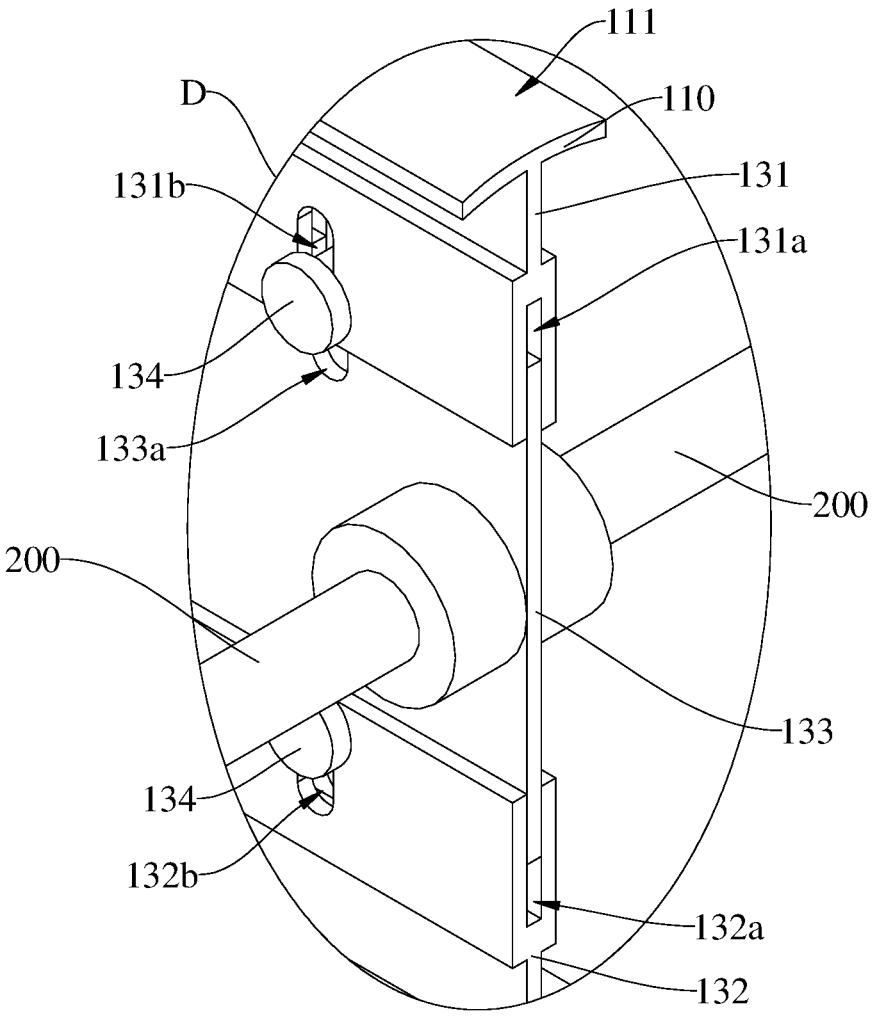
FIG. 4 is a locally enlarged view of D in FIG. 3.
Figure 5:
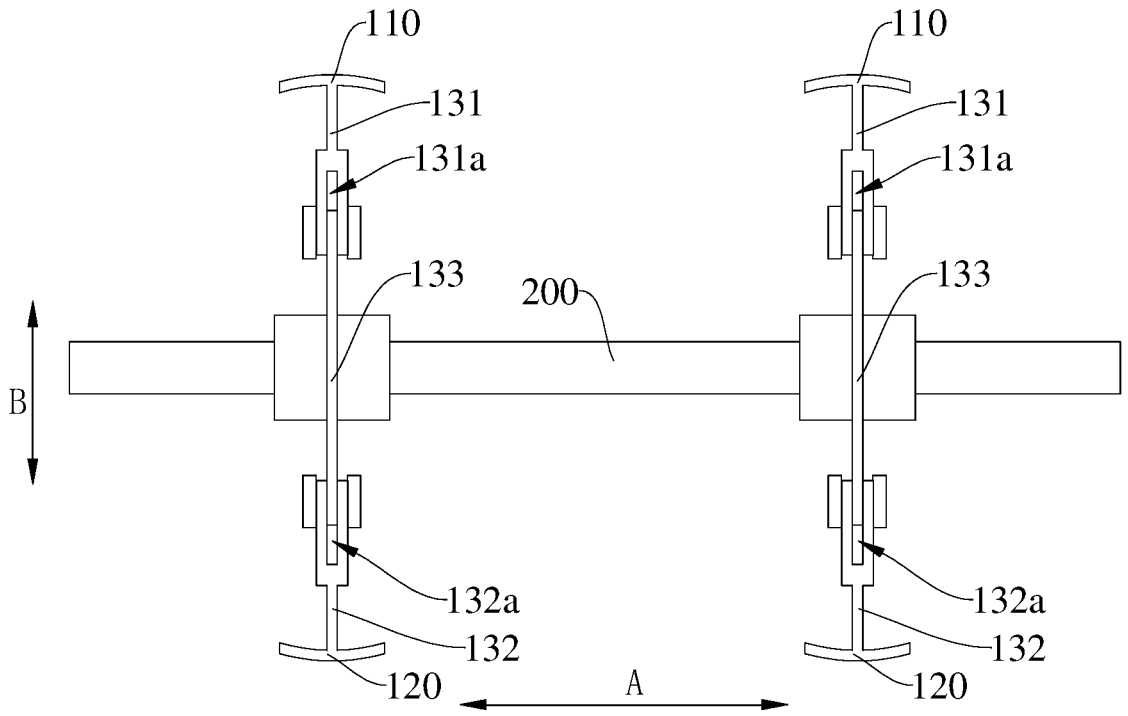
FIG. 5 is a schematic diagram of an apparatus viewed from an end face according to a second embodiment of this application.

In the embodiment shown in FIG. 3 to FIG. 5, a distance between a first support plate 110 and a second support plate 120 of a same support member 100 is adjustable, and the apparatus may be used to process heat exchangers of a plurality of models. In actual use, the distance between the first support surface 111 and the second support surface 121 can be adjusted according to design requirements of a distance between two rows of heat exchange tube sections 632. In this way, such a same apparatus may be used in a production process of heat exchangers of a plurality of models.

In actual implementation, as shown in FIG. 4 and FIG. 5, the connecting plate 130 includes a first fixing section 131, a second fixing section 132, and an adjustment section 133 connected between the first fixing section 131 and the second fixing section 132; one end of the first fixing section 131 is connected to the first support plate 110, and the other end is provided with a first opening 131*a* facing the adjustment section 133; one end of the second fixing section 132 is connected to the second support plate 120, and the other end is provided with a second opening 132*a* facing the adjustment section 133; one end of the adjustment section 133 is movably inserted into the first opening 131*a*, and the other end of the adjustment section 133 is movably inserted into the second opening 132*a*; at least one fixing section of the first fixing section 131 and the second fixing section 132 is provided with a long hole extending in the transverse direction B, and the adjustment section 133 is provided with a positioning hole matching the long hole of the fixing section; and the adjustment section 133 and the at least one fixing section are positioned by a positioning bolt 134 passing through the long hole and the positioning hole. In actual implementation, as shown in FIG. 4, the first fixing section 131 is provided with a first long hole 131*b* extending in the transverse direction B, and the second fixing section 132 is provided with a second long hole 132*b* extending in the transverse direction B. The adjustment section 133 is provided with a first positioning hole 133*a* and a second positioning hole (not shown in the figure). The first positioning hole 133*a* is used together with the first long hole 131*b*, and the second positioning hole is used together with the second long hole 132*b*.

Increasing a length of the adjustment section 133 extending into the first opening 131*a* or the second opening 132*a* can shorten the distance between the first support plate 110 and the second support plate 120. Conversely, reducing the length of the adjustment section 133 extending into the first opening 131*a* or the second opening 132*a* can increase the distance between the first support plate 110 and the second support plate 120.

It can be understood that the long hole for adjusting positioning may be arranged in the fixing section or in the adjustment section 133. In some embodiments, the first opening 131*a* and the second opening 132*a* may not be used, and the fixing section and the adjustment section 133 may be directly connected through a long hole or using another manner of adjusting a relative position, such as using a plurality of positioning holes.

Figure 6:
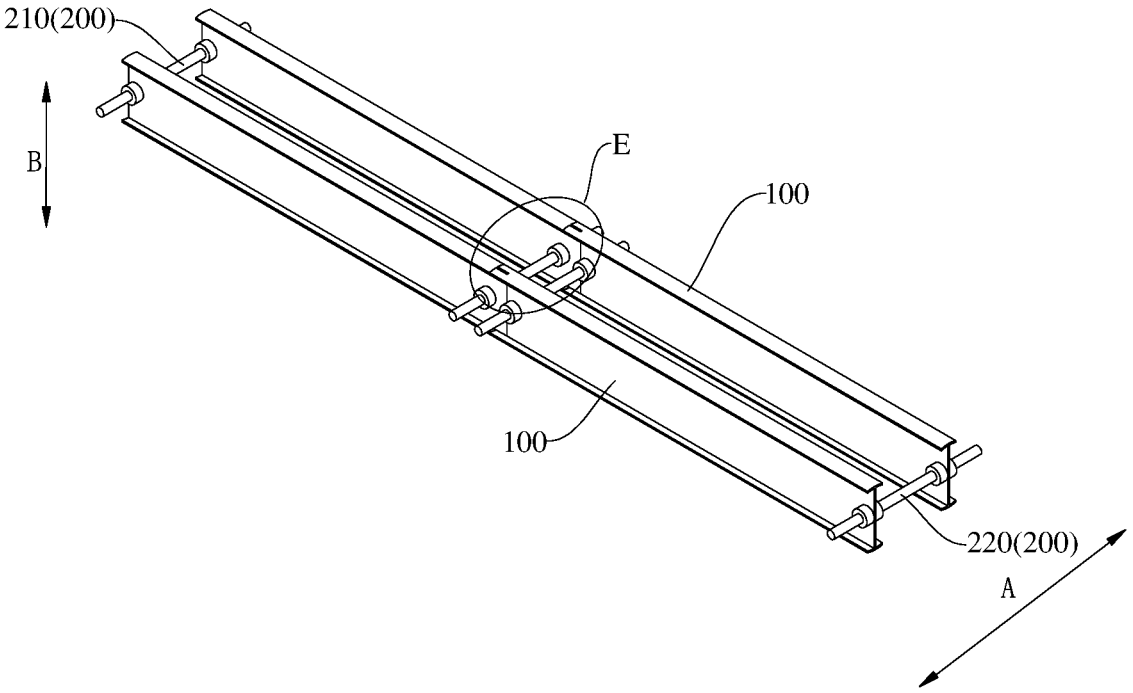
FIG. 6 is a schematic structural diagram of an apparatus according to a third embodiment of this application.
Figure 7:
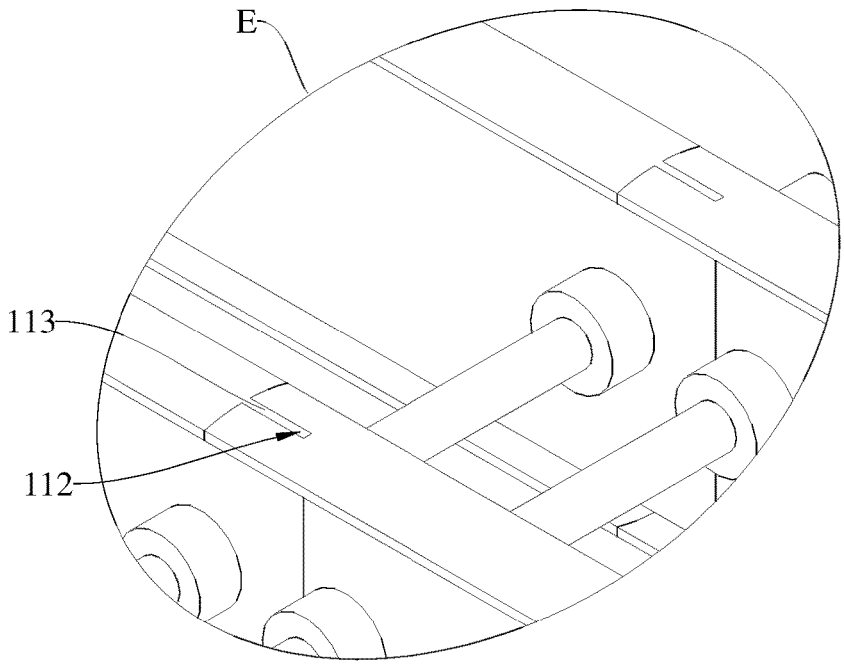
FIG. 7 is a locally enlarged view of E in FIG. 6.

In the embodiment shown in FIG. 6 and FIG. 7, each of the first support plate 110 and the second support plate 120 is divided into at least two sections in its length direction, one end of each section is provided with a concave portion 112, another end is provided with a convex portion 113 matching the concave portion 112, and in a length direction of the first support plate 110 or the second support plate 120, two adjacent sections cooperate with each other to be connected to each other by using the concave portion 112 of one section and the convex portion 113 of the other section.

The apparatus may be used to process heat exchangers of a plurality of models. In actual use, a quantity of first support plates 110 and second support plates 120 may be chosen for splicing according to design requirements of a length of the heat exchanger in an arrangement direction of the heat exchange tube 630. In this way, such a same apparatus may be used in a production process of heat exchangers of a plurality of models, thereby facilitating production and manufacturing.

In some embodiments, as shown in FIG. 1 to FIG. 6, the connecting component 200 includes an elastic member, two adjacent support members 100 are connected by using the elastic member, and a distance between the two adjacent support members 100 is changeable in the longitudinal direction A during a heat exchanger bending process. In actual implementation, the elastic member is an elastic belt.

Figure 12:
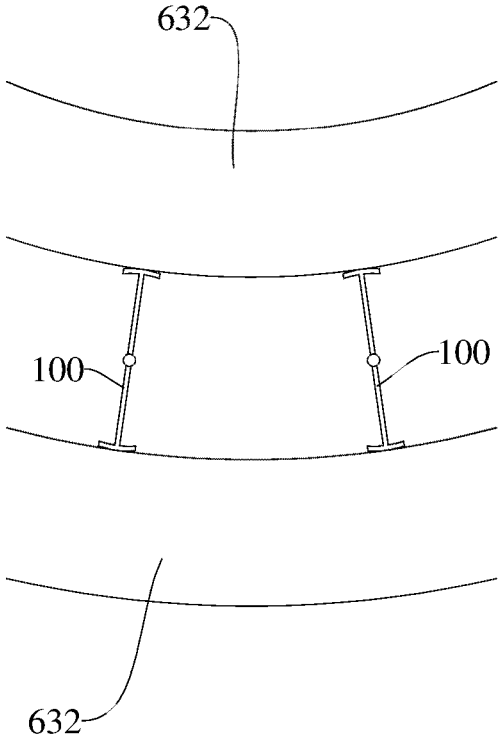
FIG. 12 is a partial schematic diagram of an apparatus in usage according to a first, second, or third embodiment of this application.

It can be understood that two adjacent support members 100 are connected by using the elastic member, so that a distance between the two adjacent support members 100 is adjustable, that is, a plurality of support members 100 can move relative to each other while having particular restriction. The plurality of support members 100 cannot move freely without restriction. As shown in FIG. 12, especially for a support member 100 corresponding to a bending area, two adjacent support members 100 are connected by using the elastic member, so that during bending, the support member 100 can move or deflect to a particular extent so as to respond to deformation of the heat exchange tube section 632 occurring during the bending process. For example, in the longitudinal direction A, a plurality of rows of heat exchange tube sections have a relative displacement. The support members 100 have a particular displacement change to be adapted to the displacement of the heat exchange tube section, which facilitates contact between a support surface and the heat exchange tube segment, provides support, and meanwhile also has a particular protective effect on the heat exchange tube section. In addition, resistance is not caused to circumferential deformation and movement of the flat tube during bending, and an overall size of the heat exchanger is not affected.

In some other embodiments, as shown in FIG. 1 and FIG. 2, the connecting component 200 includes a first connecting rod 210 and a second connecting rod 220, and the first connecting rod 210 and the second connecting rod 220 extend in parallel to each other in the longitudinal direction A and are spaced apart in the transverse direction B. The first connecting rod 210 and the second connecting rod 220 each pass through connecting plates 130 of the plurality of support members 100, and either of the first connecting rod 210 and the second connecting rod 220 is provided with an elastic sleeve 230 on both sides of each connecting plate 130 for positioning the connecting plate 130.

It can be understood that the first connecting rod 210 and the second connecting rod 220 are used to restrict the support member 100, so that the plurality of support members 100 cannot move freely without restriction, and the elastic sleeve 230 makes a distance between two adjacent support members 100 adjustable. In other words, the plurality of support members 100 can move relative to each other while having particular restriction. In this way, during bending, the support member 100 can move or deflect to a particular extent so as to respond to deformation of the heat exchange tube section 632, which imposes particular restriction on the support member while having particular flexibility. This facilitates positioning of the support member, and does not cause resistance to circumferential deformation and movement of the flat tube or affect an overall size of the heat exchanger during bending. A quantity of support members 100 on the first connecting rod 210 and the second connecting rod 220 can be adjusted to meet length requirements of bending different heat exchange tube segments.

In some embodiments, the connecting component 200 includes a first connecting rod 210 and a second connecting rod 220, and the first connecting rod 210 and the second connecting rod 220 extend in parallel to each other in the longitudinal direction A and are spaced apart in the transverse direction B. One end of the first connecting rod 210 is connected to the connecting plate 130 of the support member 100, and the other end of the first connecting rod 210 is connected to a connecting plate 130 of another support member 100 adjacent in the longitudinal direction A. One end of the second connecting rod 220 is connected to the connecting plate 130 of the support member 100, and the other end of the second connecting rod 220 is connected to the connecting plate 130 of the another support member 100 adjacent in the longitudinal direction A. It can be understood that the first connecting rod 210 and the second connecting rod 220 are used to restrict the support member 100, so that the plurality of support members 100 cannot move freely without restriction.

As shown in FIG. 8 to FIG. 11, the apparatus in the embodiment of this application may further include: a positioning component 410 and a bending guide member 420. The positioning component 410 is configured to position the heat exchanger before bending it, and fix a position for bending the heat exchanger. The bending guide member 420 is configured to guide the heat exchange tube section 632 to bend around a target direction and shape. The bending guide member 420 may include a cylinder, and the bending guide member 420 may be placed on an inner side of a row of heat exchange tube section 632 that is innermost for bending in the at least two rows of heat exchange tube sections 632.

The following describes an apparatus for bending a heat exchanger according to an embodiment of this application with reference to FIG. 13 to FIG. 20.

As shown in FIG. 13 to FIG. 20, an apparatus for bending a heat exchanger according to an embodiment of this application includes a plurality of support roller 300 and a connecting component 200.

The plurality of support rollers 300 are arranged to be spaced apart in a longitudinal direction A, and each of support rollers 300 includes a first support surface 111 and a second support surface 121 that are spaced apart in a transverse direction B and that are configured to abut against a heat exchanger. A distance between the first support surface 111 and the second support surface 121 keeps unchanged during a heat exchanger bending process, and a distance between a first support surface 111 and a second support 121 surface of one support roller 300 of any two support rollers 300 is equal to a distance between a first support surface 111 and a second support surface 121 of the other support roller 300. The connecting component 200 connects the plurality of support rollers 300 in the longitudinal direction A. The support roller 300 has a particular structural rigidity, and the support roller 300 does not deform during a heat exchanger bending process.

In an actual use process of the apparatus, the longitudinal direction A is a length direction of a heat exchange tube 630, and the transverse direction B is a distribution direction of at least two rows of heat exchange tube sections 632 of each heat exchange tube 630.

It should be noted that during a bending process, bending radii of an outer heat exchange tube section 632 and an inner heat exchange tube section 632 are different. Therefore, compared with a flat state, the heat exchange tube sections 632 have relative motion during the bending process. According to the apparatus for bending a heat exchanger in this application, the plurality of support rollers 300 are disposed to provide support between two rows of heat exchange tube sections 632, and a distance between the first support surface 111 and the second support surface 121 of each support roller 300 is equal. In this way, fixed support is formed between the two rows of heat exchange tube sections 632 to ensure that a distance between the two rows of heat exchange tube sections 632 meets design requirements and does not change significantly during the bending process.

Figure 18:
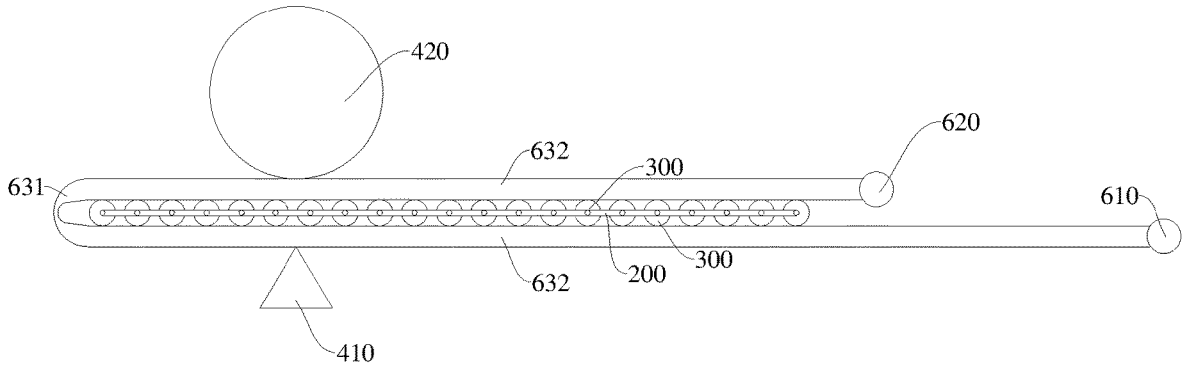
FIG. 18 is a schematic diagram of an apparatus at a completed stage of bending according to a fourth, fifth, or sixth embodiment of this application.
Figure 19:
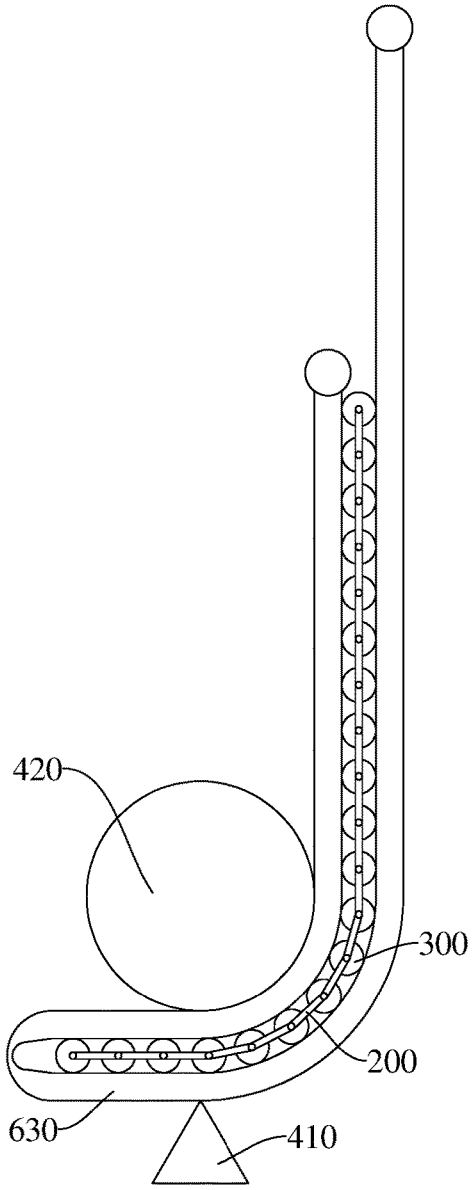
FIG. 19 is a schematic diagram of an apparatus at an initial stage of bending according to a fourth, fifth, or sixth embodiment of this application.
Figure 20:
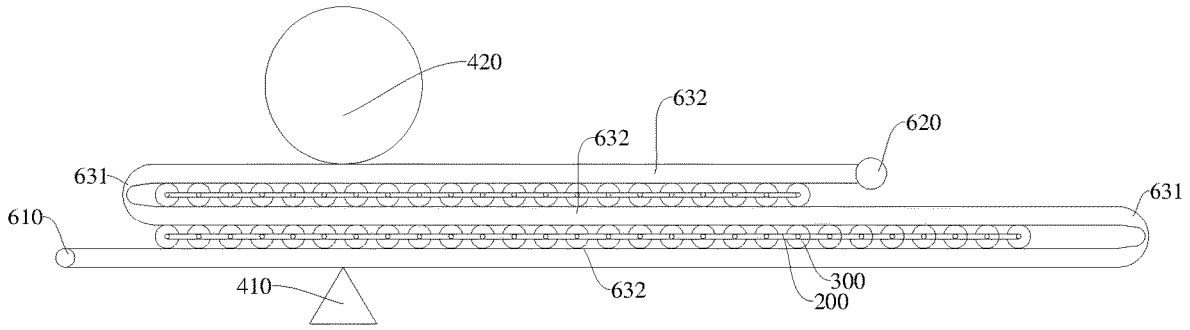
FIG. 20 is a schematic diagram of an apparatus at a completed stage of bending according to a fourth, fifth, or sixth embodiment of this application.

As shown in FIG. 18 to FIG. 20, for a plurality of rows of misaligned heat exchange tube sections 632, using the apparatus for bending a heat exchanger in this application can accurately ensure a length difference between two rows of heat exchange tube sections 632 and ensure that a processed product meets design requirements. In addition, design of the support roller can more flexibly adapt to a displacement change between different heat exchange tube sections during the bending process, so as to meet bending requirements of heat exchange tube sections of different lengths.

Certainly, the apparatus in this embodiment of this application may also be applied to alignment of headers after the bending, that is, applied to heat exchange tube sections 632 with a consistent length after a plurality of heat exchange tube segments are bent.

As shown in FIG. 18 and FIG. 19, the apparatus in this embodiment of this application can be used in a heat exchanger with two rows of heat exchange tube sections 632. As shown in FIG. 20, the apparatus in this embodiment of this application may be in a heat exchanger with more than two rows of heat exchange tube sections 632.

The apparatus for bending a heat exchanger in this application can provide fixing support for two rows of heat exchange tube sections 632, to ensure an overall size of a bent heat exchanger, and help improve efficiency and quality of a bending process.

In some embodiments, a distance between two adjacent support rollers 300 is changeable in the longitudinal direction A during a heat exchanger bending process. In this way, during bending, the support roller 300 can move or deflect to a particular extent so as to respond to deformation of the heat exchange tube section 632 during a bending process. In addition, this does not cause resistance to circumferential deformation and movement of a flat tube or affect an overall size of the heat exchanger during bending.

Figure 13:
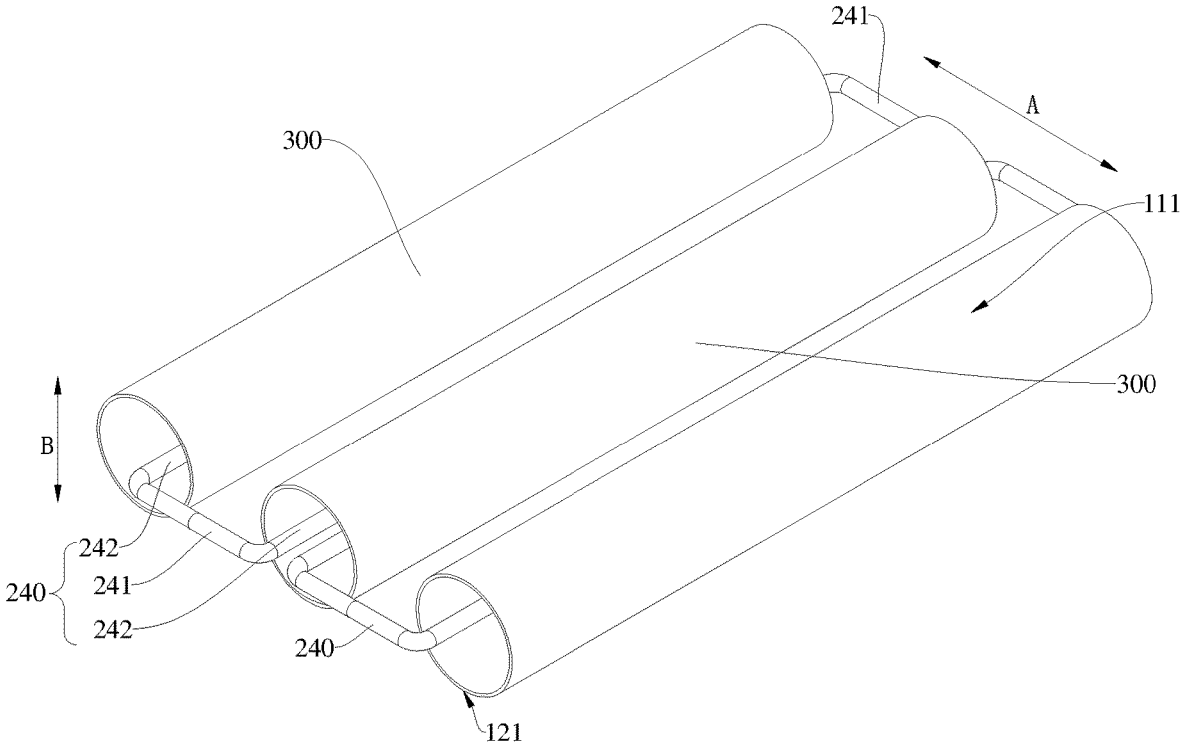
FIG. 13 is a schematic structural diagram of an apparatus according to a fourth embodiment of this application.

In some embodiments, as shown in FIG. 13, the support roller 300 is a hollow cylinder, and each of the first support surface 111 and the second support surface 121 is formed by a part of an outer wall surface of the support roller 300. A circumferential wall of the hollow cylinder is circular, which can ensure that during the bending process, at least a part of the first support surface 111 and the second support surface 121 can always implement effective support. In addition, a weight of the hollow cylinder is small, causing small pressure on the heat exchange tube segment 632.

The connecting component 200 is a rectangular connecting frame 240, and the connecting component 200 includes two longitudinal rods 241 parallel to each other and two transverse rods 242 parallel to each other. The two longitudinal rods 241 extend in the longitudinal direction A, and the two transverse rods 242 extend in an axial direction of the support roller 300. One transverse rod 242 of each rectangular connecting frame 240 passes through one support roller 300 of two adjacent support rollers 300 in the axial direction of the support roller 300, and the other transverse rod 242 passes through the other support roller 300 in the axial direction of the support roller 300.

Two longitudinal rods 241 are used to restrict the support roller 300, so that a plurality of support rollers 300 cannot move freely without restriction. A diameter of the transverse rod 242 passing through the hollow cylinder is less than an inner diameter of the hollow cylinder, and the transverse rod 242 can move in the hollow cylinder, so that a distance between two adjacent support rollers 300 is adjustable. In other words, the plurality of support roller 300 can move relative to each other while having particular restriction. In this way, during bending, the support roller 300 can move or deflect to a particular extent so as to respond to deformation of the heat exchange tube section 632 during a bending process. In addition, this does not cause resistance to circumferential deformation and movement of a flat tube or affect an overall size of the heat exchanger during bending. Moreover, the connecting component may be designed as an assemblable structure according to application requirements, so as to combine different quantities of support rollers 300 based on different heat exchange tube sizes.

Figure 16:
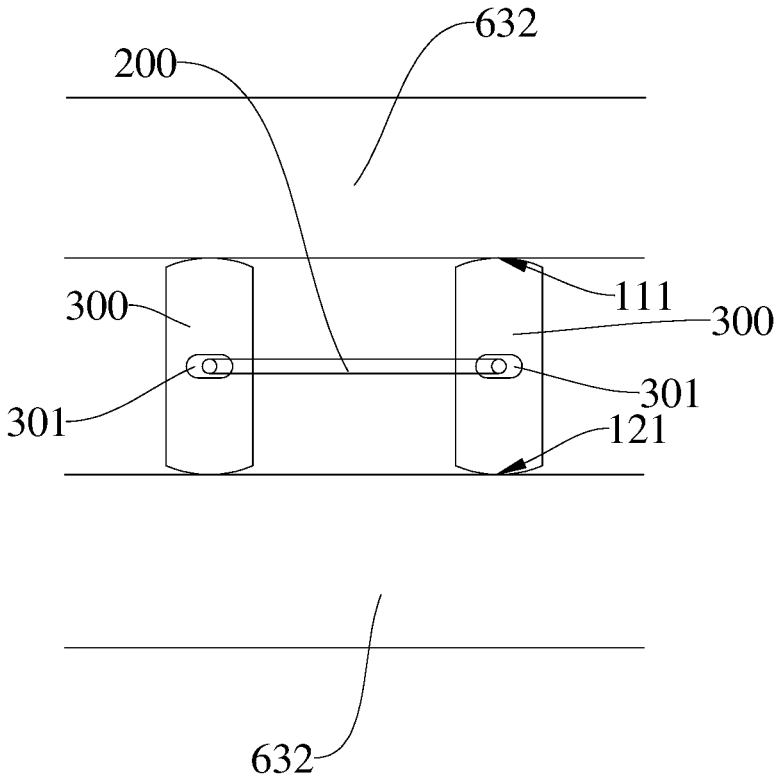
FIG. 16 is a schematic structural diagram of an apparatus according to a seventh embodiment of this application.
Figure 17:
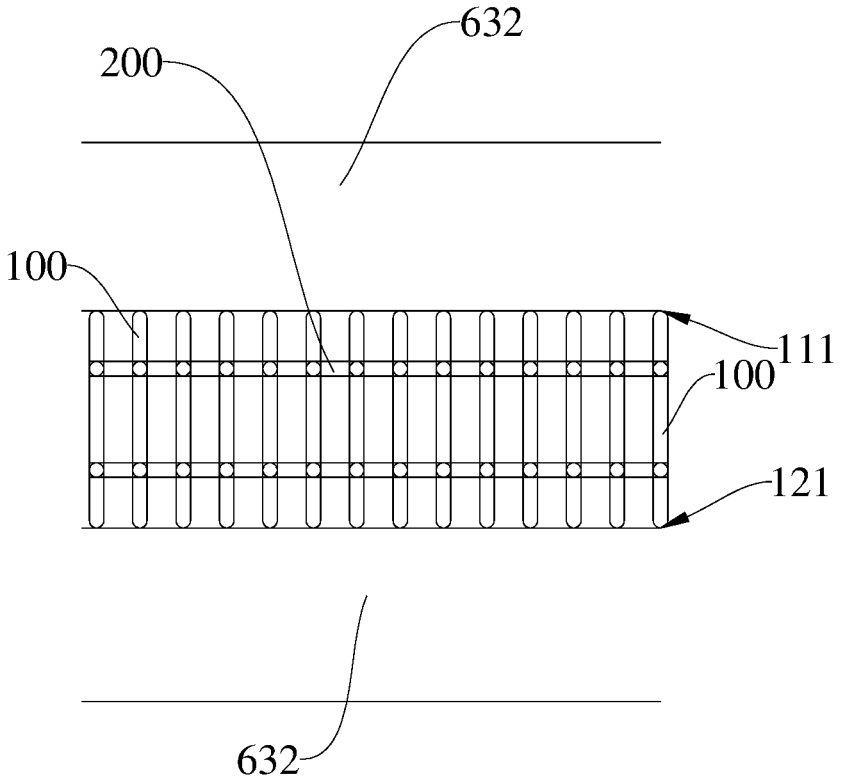
FIG. 17 is a schematic structural diagram of an apparatus according to an eighth embodiment of this application.

In some other embodiments, as shown in FIG. 16, the support roller 300 has an axial hole 301 extending in an axial direction of the support roller 300, and a first plane 302 and a second plane 303 spaced apart in the longitudinal direction A, the first support surface 111 is connected between the first plane 302 and the second plane 303 and forms an arc-shaped surface protruding away from the second support surface 121 in the transverse direction B, and the second support surface 121 is connected between the first plane 302 and the second plane 303 and forms an arc-shaped surface protruding away from the first support surface 111 in the transverse direction B.

The connecting component 200 is a rectangular connecting frame 240, and the connecting component 200 includes two longitudinal rods 241 parallel to each other and two transverse rods 242 parallel to each other. The two longitudinal rods 241 extend in the longitudinal direction A, and the two transverse rods 242 extend in an axial direction of the support roller 300. One transverse rod 242 of each rectangular connecting frame 240 passes through one support roller 300 of two adjacent support rollers 300 in the axial direction of the support roller 300, and the other transverse rod 242 passes through the other support roller 300 in the axial direction of the support roller 300.

Two longitudinal rods 241 are used to restrict the support roller 300, so that a plurality of support rollers 300 cannot move freely without restriction. A diameter of the transverse rod 242 passing through the axial hole 301 is less than a length of the axial hole 301 in the longitudinal direction A, and the transverse rod 242 can move in the axial hole 301, so that a distance between two adjacent support roller 300 is adjustable. In other words, the plurality of support roller 300 can move relative to each other while having particular restriction. In this way, during bending, the support roller 300 can move or deflect to a particular extent with a displacement further restricted, so as to respond to deformation of the heat exchange tube section 632 during a bending process. In addition, this does not cause resistance to circumferential deformation and movement of the flat tube or affect an overall size of the heat exchanger during bending.

Certainly, the support roller 300 may alternatively be in another shape.

Figure 14:
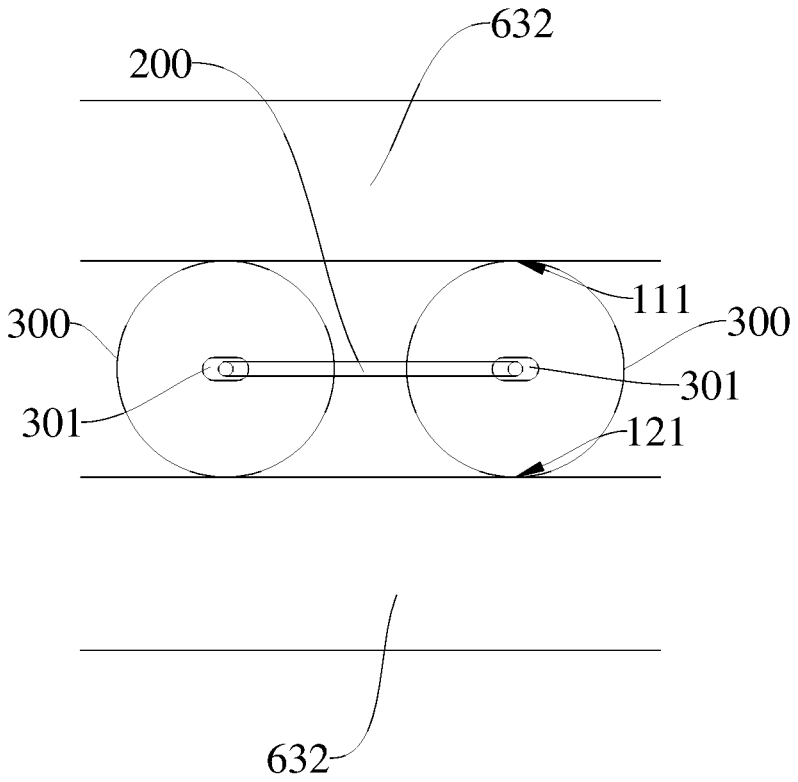
FIG. 14 is a schematic structural diagram of an apparatus according to a fifth embodiment of this application.

For example, in an embodiment shown in FIG. 14, the support roller 300 is a solid cylinder, and the solid cylinder has an axial hole 301 extending in an axial direction of the support roller 300. The connecting component 200 is a rectangular connecting frame 240, and the connecting component 200 includes two longitudinal rods 241 parallel to each other and two transverse rods 242 parallel to each other. The two longitudinal rods 241 extend in the longitudinal direction A, and the two transverse rods 242 extend in the axial direction of the support roller 300. One transverse rod 242 of each rectangular connecting frame 240 passes through one support roller 300 of two adjacent support rollers 300 in the axial direction of the support roller 300, and the other transverse rod 242 passes through the other support roller 300 in the axial direction of the support roller 300.

Figure 15:
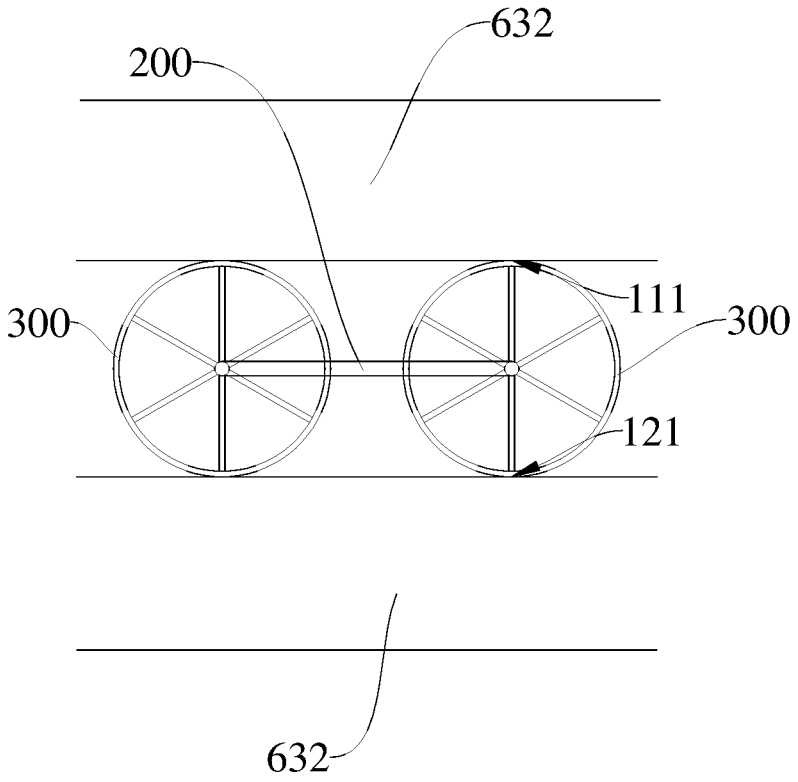
FIG. 15 is a schematic structural diagram of an apparatus according to a sixth embodiment of this application.

For example, in an embodiment shown in FIG. 15, the support roller 300 is a hollow cylinder, the hollow cylinder is provided with spokes extending in the radial direction. A plurality of spokes are arranged crosswise, and the connecting component 200 is slidably connected to one of the spokes.

As shown in FIG. 18 to FIG. 20, the apparatus in this embodiment of this application may further include: a positioning component 410 and a bending guide member 420. The positioning component 410 is configured to position the heat exchanger before bending it. The bending guide member 420 is configured to guide the heat exchange tube section 632 to bend around a target direction and shape. The bending guide member 420 may include a cylinder, and the bending guide member 420 may be placed on an inner side of a row of heat exchange tube section 632 that is innermost for bending in the at least two rows of heat exchange tube sections 632.

According to the apparatus in this application, a shape of the support roller 300 or the support member 100 may be an "I" shaped, or a cylindrical shape, or a double-fan shape, or a round drum shape.

This application further discloses a method for bending a heat exchanger.

The bending method in this application includes:

placing the apparatus for bending a heat exchanger according to any one of the foregoing embodiments between at least two rows of substantially parallel heat exchange tube sections 632, where a first support surface 111 and a second support surface 121 each abut against the heat exchange tube section 632 and/or a fin, a transverse direction B of a support member 100 is substantially parallel to a width direction of the heat exchange tube section 632, and a longitudinal direction A of the support member 100 is substantially parallel to a length direction of the heat exchange tube section 632; and simultaneously bending the at least two rows of heat exchange tube sections 632 around a direction parallel to an axial direction of a first header 610 and an axial direction of a second header 620.

A plurality of support members 100 or support rollers 300 are disposed to provide support between two rows of heat exchange tube sections 632, and a distance between the first support surface 111 and the second support surface 121 of each support member 100 is equal. In this way, fixed support is formed between the two rows of heat exchange tube sections 632 to ensure that a distance between the two rows of heat exchange tube sections 632 meets design requirements and does not change significantly during a bending process.

According to the method for bending a heat exchanger, a heat exchanger with heat exchange tube segments 632 parallel to each other can be formed, to ensure an overall size of a bent heat exchanger, and high efficiency and quality of a bending process.

In some embodiments, a distance between two adjacent support members 100 or support rollers 300 is changeable in the longitudinal direction A during a bending process. In this way, during bending, the support member 100 or the support roller 300 can move or deflect to a particular extent so as to respond to non-uniform deformation of the heat exchange tube sections 632. In addition, this does not cause resistance to circumferential deformation and movement of a flat tube or affect an overall size of the heat exchanger during bending.

For a heat exchanger with a relatively large length in a length direction of the header, a plurality of the apparatuses for bending a heat exchanger may be placed in the length direction of the header.

In some embodiments, as shown in FIG. 8 to FIG. 11 and FIG. 18 to FIG. 20, the method for bending a heat exchanger in this application further includes: before the bending the at least two rows of heat exchange tube sections 632, positioning the heat exchanger; and placing a bending guide member 420 on an inner side of a row of heat exchange tube section 632 that is innermost for bending in the at least two rows of heat exchange tube sections 632.

In the descriptions of this application, it should be noted that, unless otherwise expressly specified or defined, terms such as "install", "connect", and "connected to" should be understood in a broad sense. For example, a "connection" may be a fixed connection, may be a detachable connection, or may be an integrated connection; or may be a mechanical connection, or an electrical connection; or may be a direct connection, or an indirect connection through an intermediate medium; or may be an internal connection between two elements. A person of ordinary skill in the art can understand specific meanings of the foregoing terms in this application with reference to specific circumstances.

In the description of this specification, descriptions with reference to terms such as "an embodiment", "some embodiments", "illustrative embodiment", "example", "specific example", or "some examples" mean that specific features, structures, materials, or characteristics described with reference to the embodiment or example are included in at least one embodiment or example of this application. In this specification, illustrative descriptions of the foregoing terms do not necessarily mean a same embodiment or example. Moreover, the described specific features, structures, materials, or characteristics can be combined in any one or more embodiments or examples in an appropriate manner.

Although the embodiments of this application are shown and described, a person of ordinary skill in the art can understand that various changes, modifications, substitutions, and variants can be made based on these embodiments without departing from the principle and purpose of this application. The scope of this application is defined by the claims and their equivalents.

What is claimed is:

1. An apparatus for bending a heat exchanger, wherein the apparatus comprises:

a plurality of support rollers, wherein the plurality of support rollers are arranged to be spaced apart in a longitudinal direction, each of the support rollers comprises a first support surface and a second support surface that are spaced apart in a transverse direction and that are configured to abut against the heat exchanger, a distance between the first support surface and the second support surface keeps unchanged during the heat exchanger bending process, and a distance between the first support surface and the second support surface of one support roller of any two of the plurality of support rollers is equal to a distance between the first support surface and the second support surface of the other support roller of the two support rollers; and a connecting component, wherein the connecting component connects the plurality of support rollers in the longitudinal direction, wherein the connecting component is a rectangular connecting frame and comprises two longitudinal rods parallel to each other and two transverse rods parallel to each other; the two longitudinal rods extend in the longitudinal direction, and the two transverse rods extend in an axial direction of the support rollers; and one transverse rod of each rectangular connecting frame passes through one of two adjacent support rollers of the plurality of support rollers in the axial direction of the support roller, and the other transverse rod passes through the other of the two adjacent support rollers in the axial direction of the support roller.

2. The apparatus according to claim 1, wherein each of the plurality of support rollers is a hollow cylinder, and each of the first support surface and the second support surface is formed by a part of an outer wall surface of each of the plurality of support rollers.

3. The apparatus according to claim 1, wherein each of the plurality of support rollers has an axial hole extending in an axial direction of the support roller, and a first plane and a second plane spaced apart in the longitudinal direction, the first support surface is connected between the first plane and the second plane and forms an arc-shaped surface protruding away from the second support surface in the transverse direction, and the second support surface is connected between the first plane and the second plane and forms an arc-shaped surface protruding away from the first support surface in the transverse direction.

4. The apparatus according to claim 1, wherein a distance between two adjacent support rollers of the plurality of support rollers is changeable in the longitudinal direction during the heat exchanger bending process.

5. A method for bending a heat exchanger, wherein the heat exchanger comprises a first header, a second header, and a plurality of heat exchange tubes; the first header and the second header are arranged in parallel and adjacent to each other, and the heat exchange tube is a flat tube; a first end of the heat exchange tube is connected to the first header, and a second end of the heat exchange tube is connected to the second header, so as to connect the first header and the second header; the plurality of the heat exchange tubes are distributed in a length direction of the first header or the second header; the plurality of heat exchange tubes are arranged parallel to each other in the length direction of the first header or the second header; fins are arranged between adjacent flat tubes, and at least one of the plurality of heat exchange tubes comprises a bent section and at least two rows of substantially parallel heat exchange tube sections in a width direction of the heat exchange tube; and the bending method comprises:

placing the apparatus for bending the heat exchanger between the at least two rows of substantially parallel heat exchange tube sections, wherein the apparatus comprises:

a plurality of support rollers, wherein the plurality of support rollers are arranged to be spaced apart in a longitudinal direction, each of the support rollers comprises a first support surface and a second support surface that are spaced apart in a transverse direction and that are configured to abut against the heat exchanger, a distance between the first support surface and the second support surface keeps unchanged during the heat exchanger bending process, and a distance between the first support surface and the second support surface of one support roller of any two of the plurality of support rollers is equal to a distance between the first support surface and the second support surface of the other of the plurality of support rollers; and a connecting component, wherein the connecting component connects the plurality of support rollers in the longitudinal direction, wherein the connecting component is a rectangular connecting frame and comprises two longitudinal rods parallel to each other and two transverse rods parallel to each other; the two longitudinal rods extend in the longitudinal direction, and the two transverse rods extend in an axial direction of the support rollers; and one transverse rod of each rectangular connecting frame passes through one of two adjacent support rollers of the plurality of support rollers in the axial direction of the support roller, and the other transverse rod passes through the other of the two adjacent support rollers in the axial direction of the support roller;

wherein the first support surface and the second support surface each abut against the heat exchange tube section, or the fin, or the heat exchange tube section and the fin; and a transverse direction of the support member is substantially parallel to the width direction of the heat exchange tube section, and a longitudinal direction of the support member is substantially parallel to a length direction of the heat exchange tube section; and simultaneously bending the at least two rows of heat exchange tube sections around a direction parallel to an axial direction of the first header and an axial direction of the second header.

* * * * *